US009366487B2

(12) United States Patent
Riondet et al.

(10) Patent No.: US 9,366,487 B2
(45) Date of Patent: Jun. 14, 2016

(54) HEAT EXCHANGER HAVING ENHANCED PERFORMANCE

(75) Inventors: Christian Riondet, Bourgogne (FR); Jean-Marc Lesueur, Reims (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 373 days.

(21) Appl. No.: 13/637,635

(22) PCT Filed: Mar. 29, 2011

(86) PCT No.: PCT/EP2011/054843

§ 371 (c)(1),
(2), (4) Date: Mar. 8, 2013

(87) PCT Pub. No.: WO2011/120977

PCT Pub. Date: Oct. 6, 2011

(65) Prior Publication Data

US 2013/0160973 A1 Jun. 27, 2013

(30) Foreign Application Priority Data

Mar. 31, 2010 (FR) ..... 10 52447

(51) Int. Cl.
*F28D 1/00* (2006.01)
*F28F 9/02* (2006.01)
(Continued)

(52) U.S. Cl.
CPC ..... *F28F 9/182* (2013.01); *F28F 1/006* (2013.01); *F28F 9/0224* (2013.01); *F28F 9/0226* (2013.01)

(58) Field of Classification Search
CPC ..... F28F 9/0246; F28F 9/02; F28F 9/0224
USPC ..... 165/158, 173, 148
See application file for complete search history.

(56) References Cited

U.S. PATENT DOCUMENTS 4,159,741 A * 7/1979 Nonnenmann et al. ..... 165/173
4,316,503 A * 2/1982 Kurachi et al. ..... 165/175
4,582,127 A * 4/1986 Moranne ..... 165/83
(Continued)

FOREIGN PATENT DOCUMENTS

DE 103 60 472 A1 7/2004
DE 10 2006 045 200 A1 4/2008
(Continued)

OTHER PUBLICATIONS

International Search Report w/translation from PCT/EP2011/054843 mailed on Nov. 28, 2011 (4 pages).

*Primary Examiner* — Allen Flanigan
*Assistant Examiner* — Jason Thompson
(74) *Attorney, Agent, or Firm* — Osha Liang LLP

(57) ABSTRACT

The invention relates to a heat exchanger including at least one elongate tube (3) adapted for the flow of a coolant, and at least one collection box (5) for such a coolant and into which one end of said tube leads, wherein the collection box includes a collector (9) having an element for receiving the end of said tube, the receiving element including a portion (19) projecting inwardly and shaped into an area for supporting said tube. According to the invention, the receiving element further includes a connection portion (21) for the inwardly projecting portion opposite the collector, and said connection portion protrudes on the side of the collector opposite the collection box such that said inwardly projecting portion (19) and said connection portion (21) have mutually opposite projecting directions.

14 Claims, 6 Drawing Sheets

(51) Int. Cl.
*F28F 9/18* (2006.01)
*F28F 1/00* (2006.01)

(56) References Cited

U.S. PATENT DOCUMENTS 4,790,372 A * 12/1988 Gemeinhardt et al. ..... 165/173
5,327,959 A 7/1994 Saperstein et al.
5,676,200 A * 10/1997 Laveran ..... 165/83
6,082,439 A * 7/2000 Kato et al. ..... 165/79
7,044,208 B2 * 5/2006 Kawakubo et al. ..... 165/173
8,776,873 B2 * 7/2014 Mross ..... F28D 1/05391 165/173
2004/0188070 A1 * 9/2004 Kruger et al. ..... 165/140
2005/0051315 A1 * 3/2005 Ozaki et al. ..... 165/173
2006/0266509 A1 * 11/2006 Forster et al. ..... 165/173
2007/0012425 A1 * 1/2007 Sugito et al. ..... 165/81
2011/0240271 A1 * 10/2011 Mross et al. ..... 165/166

FOREIGN PATENT DOCUMENTS

EP 0 990 868 B1 4/2000
EP 1 384 968 A1 1/2004
FR 2 783 903 A1 3/2000
JP 2002 267389 A 9/2002

* cited by examiner

HEAT EXCHANGER HAVING ENHANCED PERFORMANCE

The invention relates to a thermal exchanger, in particular for use in a motor vehicle and to a collecting plate of such an exchanger.

Such exchangers, for example radiators for cooling the engine, have a succession of elongate tubes wherein circulates a coolant fluid. Thermal exchanges occur between the coolant fluid and the fluid externally in contact with the tubes, usually air.

Two collecting boxes receive the respective ends of these tubes, thus ensuring that fluid of the tubes is placed in communication with one another. These boxes each comprise a cover and a manifold in the form of a plate.

The sealing of the junction between the cover and the manifold is usually achieved by means of a seal extending along the edge of the box. As an option, the edge of the manifold can be formed as a slot or groove forming a housing for this seal. This groove also ensures the relative positioning of the cover and the manifold.

The manifold is perforated with holes suitable for the passage of the tubes such that the latter lead to the inside of a respective collecting box at each of their ends. Once in place, the tubes are secured to the manifold, usually by brazing.

In order to enhance the rigidity of the connection between each tube and the manifold, it is common practice to form a zone of the box surrounding each of the holes into a collar of material. Each collar increases the guide length of the tube in the hole and increases the surface area available for the brazing of the tube to the cover.

The collars are obtained by pushing back the material of the manifold during the production of the holes. The height of the collars, that is to say the distance by which they protrude from the plate, usually on the inside of the collecting box, is linked to the thickness of the material used: the thicker the material, the higher the collars.

For reasons of reliability, the end of the tubes protrudes from the collar to the inside of the collecting box. In the regions of the collecting boxes situated between the end portions of the tubes that protrude from the collars, and those situated between the collars themselves, the coolant fluid that flows in the box forms vortexes. The latter generate internal pressure losses and adversely affect the performance of the exchanger. Moreover, the regions in question constitute "dead" zones, that is to say zones that are practically useless to the operation of the exchanger.

EP 0990868 B1 proposes to reduce these pressure losses by having the collars protrude on the side of the manifold outside the collecting box. The collars are formed by piercing the holes in the opposite direction to the direction of insertion of the tubes, that is to say from the inside of the manifold to the outside of the latter. This makes the assembly of the exchanger difficult, or even unachievable, because the holes then have no insertion cone: the cone formed when pushing back the material of the manifold has a narrowing direction opposite to the direction of insertion of the tubes.

The situation is aggravated by the fact that the tubes must usually be installed together simultaneously for reasons of production rate.

And this situation becomes yet worse for exchangers with a reduced pitch (the distance separating the axes of two adjacent tubes), typically between 5 and 8 millimeters approximately.

FR 2 783 903 proposes to join an additional plate to the manifold against the inside face of the latter. The space between the portions of the tubes protruding from the collars, in this instance internal collars, is filled by the additional plate. The latter also increases the resistance of the assembly to the swaging forces and protects the ends of the tubes. This plate however is an additional part to be manufactured and to be assembled to the rest of the exchanger. The result of this is an increase in production costs.

EP 1 384 968 proposes to make the box in several portions: a first, intermediate, portion is swaged onto the manifold while a second, external, portion is secured to the first by bonding, swaging or welding. The intermediate portion is formed so as to make the tubes easier to insert. In this case, the drawbacks associated with the addition of an extra part to the exchanger arise again.

U.S. Pat. No. 5,327,959 proposes through-holes furnished with a bevel. The latter is formed so as to prevent the tubes from penetrating the inside of the collecting box. The risk of creating a vortex is then avoided. However, the zone designed for the contact between the bevels and the ends of the tubes being very reduced, there is no assurance that this contact takes place for all the tubes, nor that the brazing can take or hold in this location. Finally, the mechanical strength of the exchanger is reduced.

The object of the invention is to improve the existing situation. The intended exchanger comprises at least one elongate tube adapted to the circulation of a coolant fluid and at least one collecting box for such a fluid into which one end of said tube leads, the collecting box comprising a manifold having a receiving element for the end of said tube, the receiving element comprising an inwardly protruding portion formed in a retention zone for this tube. According to the invention, the receiving element also comprises a connecting portion for connecting the inwardly protruding portion to the rest of the manifold and this connecting portion protrudes on the side of the manifold opposite to the collecting box so that the inwardly protruding portion and the connecting portion have mutually opposite protruding directions.

By virtue of this configuration of the exchanger, it becomes possible to place the end of the tubes below a plane containing the upper face of the manifold. This prevents the creation of any vortex. It however retains the advantages of a sufficient guide length of the tube in the orifice and an easier insertion. Incidentally, this also makes it possible to reduce the length of the tubes and hence to make raw material savings.

The inwardly protruding portion rises toward the inside of the collecting box. The receiving element is formed in the manifold. The protruding portion has an orifice with a cross section suitable for an end zone of the tube to pass.

According to various embodiments:

- the orifices allowing the tube or tubes to pass are away from the connecting portion,
- the protruding portion and the connecting portion rise in the longitudinal direction of the tube,
- the retention zone is arranged to match the shape of the outside of the tube in the vicinity of its end leading into the collecting box,
- the connecting zones have bases by which they are connected to the rest of the collecting plate, situated in one and the same plane, called the internal envelope plane of the manifold, and the inwardly protruding portion is set back from said plane, so that said zone for the retention of the tube does not protrude inwardly beyond said plane,
- the end of the tube protrudes at most by 2 millimeters from said internal envelope plane of the manifold, on the side of this plane oriented toward the inside of the collecting box, the end of the tube is placed substantially on the internal envelope plane of the manifold, the end of the tube is situated at a distance less than 4 millimeters from the internal envelope plane of the manifold, on the side of this plane oriented toward the outside of the collecting box, the manifold is made of a plate material with a thickness of between 0.8 and 1.8 millimeter, preferably between 1.2 and 1.5 millimeter, the exchanger comprises a cluster of tubes adapted to the circulation of the coolant fluid, wherein the cluster has a spacing pitch of the tubes of between 5 and 15 millimeters, and preferably between 6 and 10 millimeters, the box comprises a cover swaged onto said collecting box, the box comprises a cover braised onto said collecting plate, said tube or tubes are obtained by folding a sheet of material, said tubes are furnished with corrugations protruding inwardly.

The invention also relates to a collecting plate for a heat exchanger furnished with the features described above.

Other features and advantages of the invention will appear on examination of the following detailed description and of the appended drawings in which.

The appended drawings may not only serve to supplement the invention but also contribute to its definition if necessary.

Figure 1:
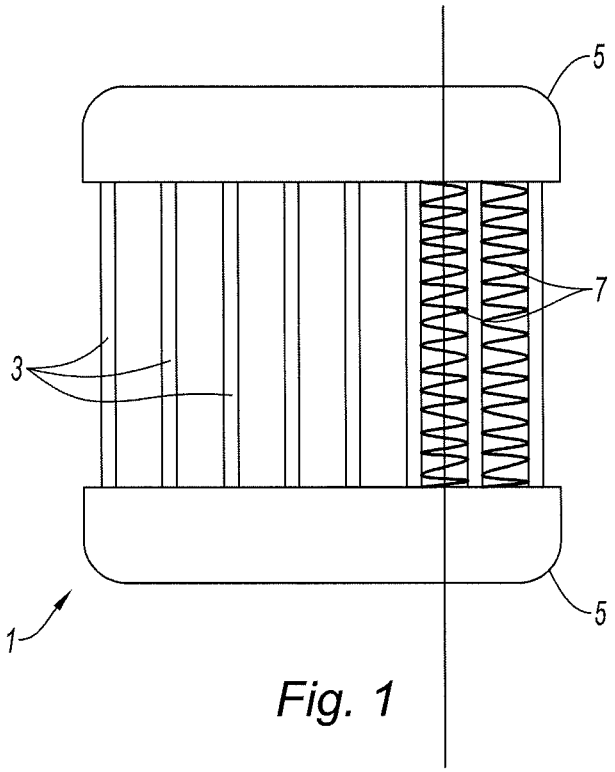
FIG. 1 represents a front view of a heat exchanger.
Figure 2:
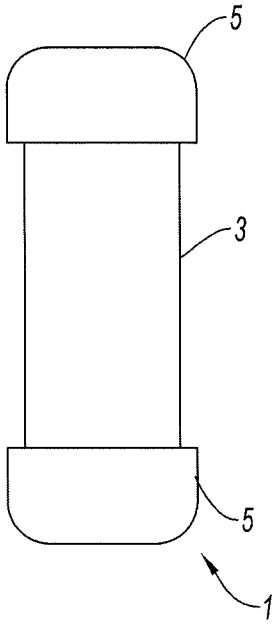
FIG. 2 represents a view from the left of the exchanger of FIG. 1.

FIGS. 1 and 2 show a thermal exchanger 1 for use in a motor vehicle, for example for cooling the engine.

The exchanger 1 comprises elongate tubes 3 for the circulation of a coolant fluid, said tubes being placed in a cluster. The tubes 3 are aligned in one or more rows or layers. FIG. 2 shows that the exchanger 1 has one layer of tubes 3.

Each of the ends of each of the tubes 3 leads into a respective collecting box 5. The exchanger 1 thus comprises two analogous collecting boxes 5 which place the tubes 3 in fluidic communication with one another. The collecting boxes 5 have a generally parallelepipedal appearance. They are placed facing one another.

Each time, between two adjacent tubes 3 there is a heat-exchange insert 7 of corrugated form and in which the top of each of the oscillations is in contact with one of the two adjacent tubes 3.

In operation, the exchanger 1 allows a thermal exchange between the coolant fluid circulating in the tubes 3 and a fluid passing outside the exchanger, usually air.

Figure 3:
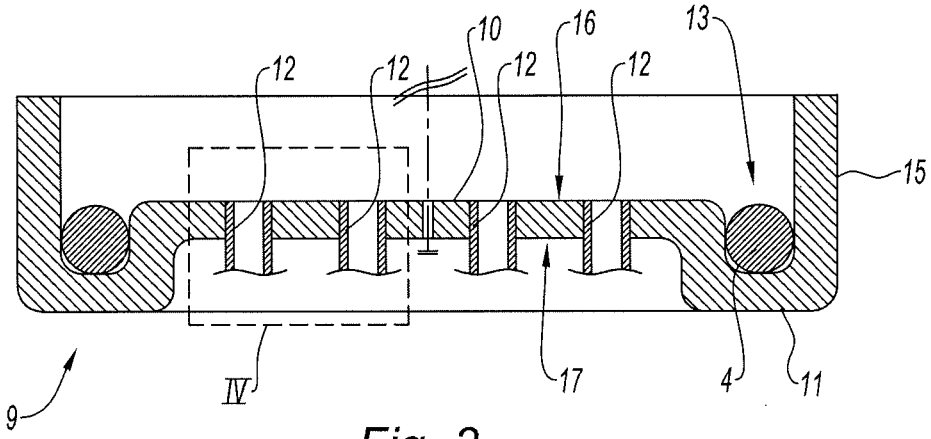
FIG. 3 represents a view in longitudinal section of a manifold for the exchanger of FIGS. 1 and 2.

FIG. 3 shows a plate 9 formed as a manifold for one said box (not shown), the manifold and a cover (not shown in this figure) jointly forming a collecting box 5. In this instance the cover is of generally parallelepipedal form, while the manifold extends generally in one plane and rectangularly.

The manifold 9 has a central portion 10 and a border portion 11 surrounding this central portion 10. The central portion 10 has a plurality of through-orifices 12 suitable in shape and in position for the insertion and the passage of an end portion of the tubes 3.

The border portion 11 has a circumferential groove or slot 13 suitable for the housing of a seal 14. The seal 14 is used to seal the assembly of the cover and manifold 9 of the box. A peripheral portion 15 of the manifold 9 is folded so as to protrude, almost perpendicularly, from the central portion 10. This peripheral portion is designed to come close to the lateral walls of the cover and to swage it onto the manifold.

The central portion 10 extends between two planes that are parallel with one another and with the general extension plane of the manifold 9:

a first plane situated on the side of the general extension plane turned toward the inside of the collecting box 5, or internal envelope plane 16 of the manifold;

a second plane situated on the side of the general extension plane turned toward the outside of the collecting box 5, or the external envelope plane 17.

According to one aspect of the invention, the end of the tubes 3 received in the orifices 12 is substantially on the internal envelope plane 16 or slightly short of it.

Figure 4:
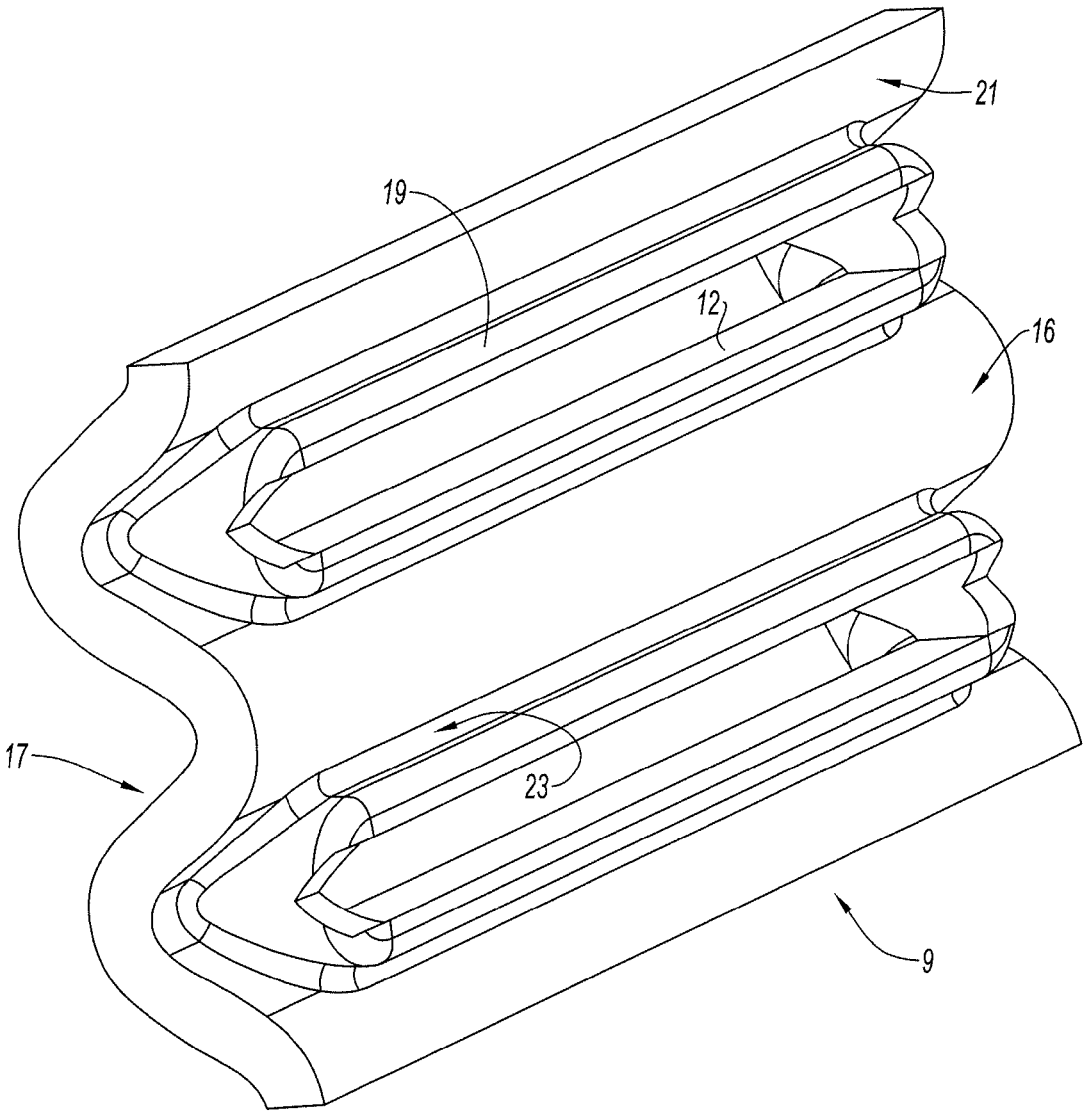
FIG. 4 represents a cutaway view in perspective and from above of a detail IV of the manifold of FIG. 3.
Figure 5:
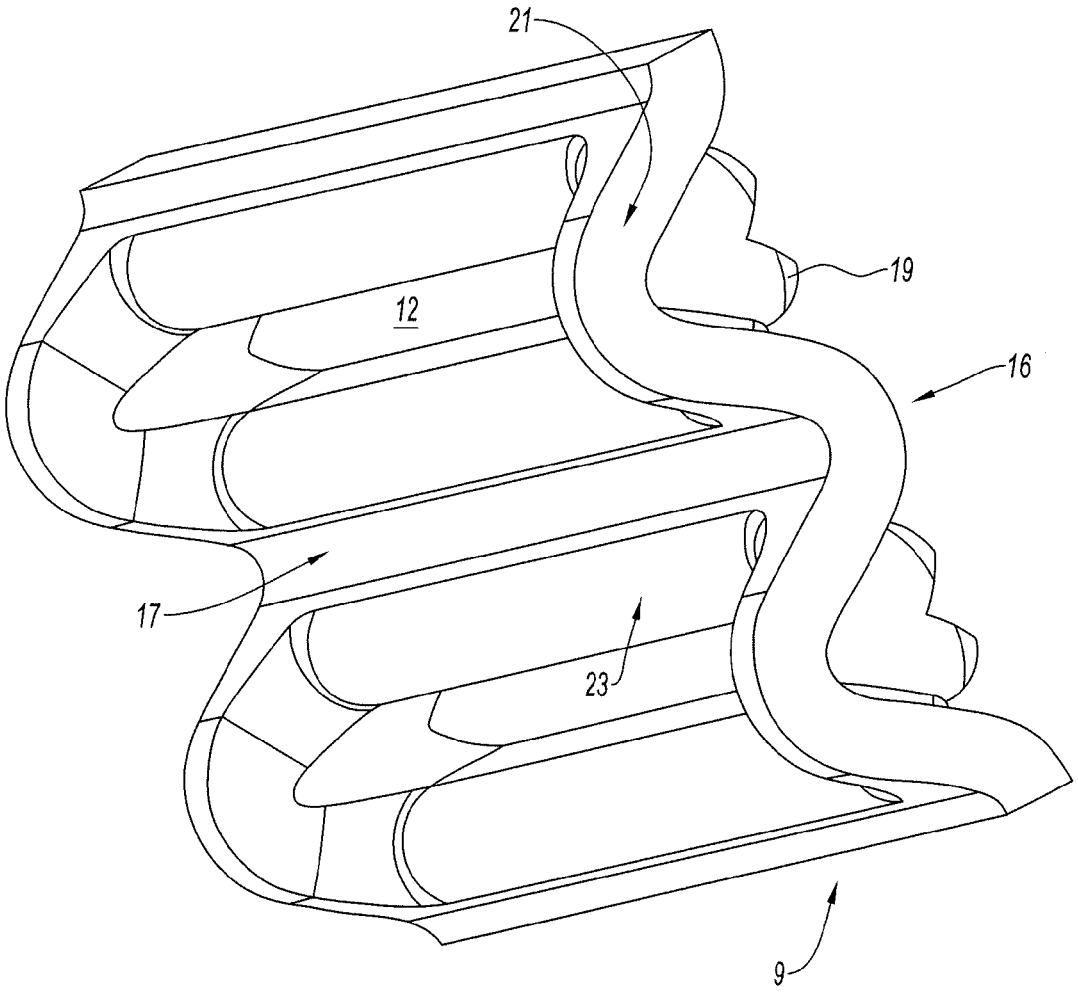
FIG. 5 is similar to FIG. 4, the manifold being seen from below.
Figure 6:
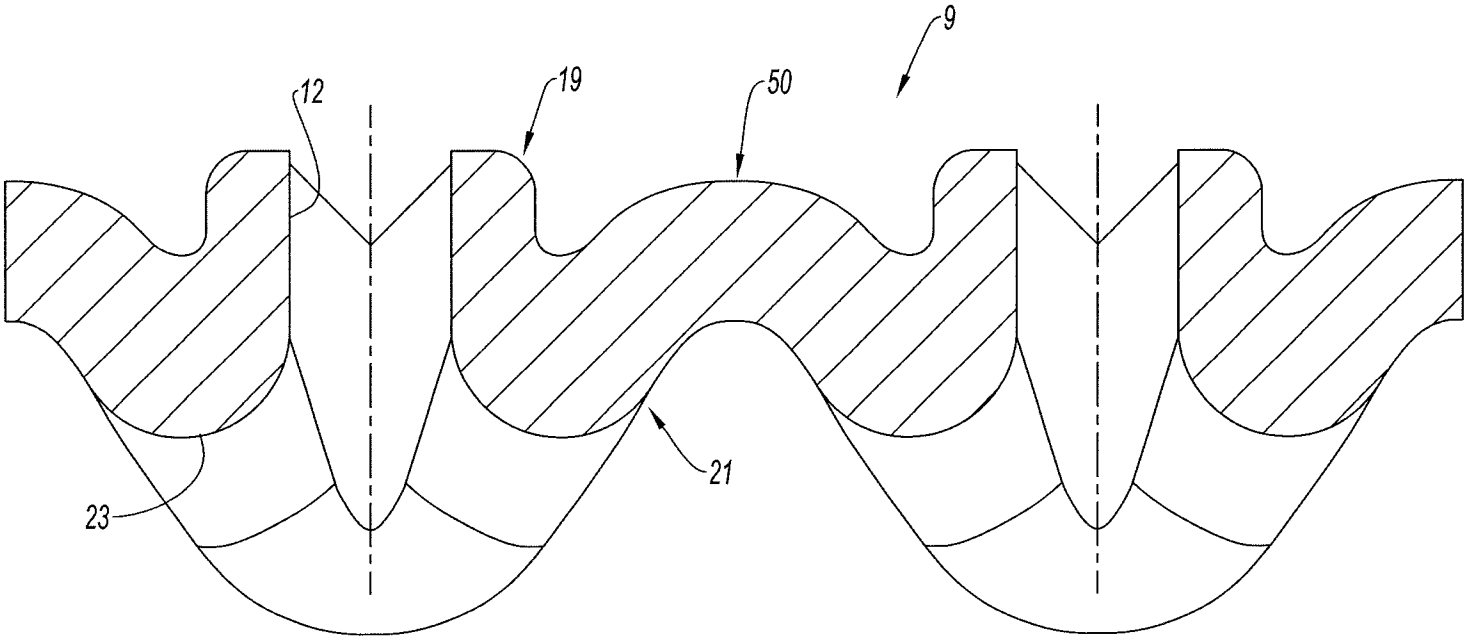
FIG. 6 represents a view in longitudinal section of the detail IV.

FIGS. 4 to 6 show in detail a portion of the manifold 9 comprising any one of the orifices 12.

The manifold 9 is formed so as to have a portion forming a collar 19 which borders the orifice 12. This collar 19 protrudes from the internal surface of the manifold 9 in a direction practically perpendicular to the general extension plane of this manifold 9 and going from the external envelope face 17 to the internal envelope face 16. The free end of the collar 19 is set back from the internal envelope plane 16. The collar 19 is made by pushing back material of the plate, such that a slight narrowing of the section of the orifice 12 is formed on the external surface of the manifold 9.

A connecting portion 21 connects the collar 19 to the same portion 21 corresponding to the passageway of the next tube. The connecting portion 21 is made in the form of a portion that protrudes from the manifold 9 in a direction perpendicular to the general extension plane, going from the internal envelope plane 16 to the external envelope plane 17. This connecting portion is situated beneath the general extension plane.

In other words, the manifold 9 has, in the vicinity of each orifice 12, a receiving element for the end of a tube 3 that comprises an inwardly protruding portion formed as a retention zone for this tube, a portion for connecting the protruding portion to the manifold, this connecting portion protruding on the side of the manifold 9 that is opposite to the collecting box, the protruding portion and the connecting portion having mutually opposite protruding directions.

In this instance, the orifices 12 are adapted to the passage of tubes that are known as flat, that is to say of which the cross section is delimited by two long straight edges parallel with one another and connected together, on each occasion, by a semicircular edge. The collars 19 follow the shape of the orifices 12 that can be called oblong.

In this instance, the connecting portion 21 is made by forming the coverplate 9 locally as an elongate boss along the length of the orifices 12. In cross section, the boss has an undulating appearance. This undulation may extend over practically the whole direction concerned, in particular when there are several rows of tubes: it is then possible to use one and the same connecting portion 21 for several collars 19 aligned in their longitudinal direction.

The collars 19 are attached at their base to their respective connecting portion 23 by means of a bend 23 which also makes the insertion of the tubes easier.

Each collar 19 can also be seen as a bead of material surrounding the orifice 12.

In FIGS. 4 to 6, the manifold therefore has a succession of bosses analogous to the connecting zone, that is to say in the form of undulations, attached to one another in the transverse direction of the orifices 12. In other words, the connecting portions 21 are attached to one another. The tops of the undulations are alternately contained in the internal envelope plane 16 and in the internal envelope plane 17. The orifice 12 coincides, in the general extension plane, with a crest line contained in the internal envelope plane 17.

As can be seen in FIG. 6, the connecting zones 23 comprise bases 50 which connect them together and by which they are connected to the rest of the collecting plate.

Figure 7:
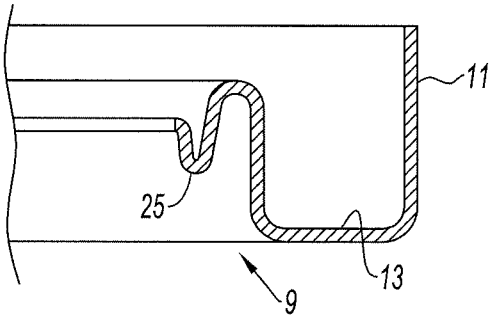
FIG. 7 represents schematically a view in section of a first embodiment of a manifold according to the invention in the transverse direction of said manifold.

FIG. 7 shows an orifice 12 for the passage of a tube in a manifold 9, furnished with a slot 13 for the housing of a seal.

Figure 8:
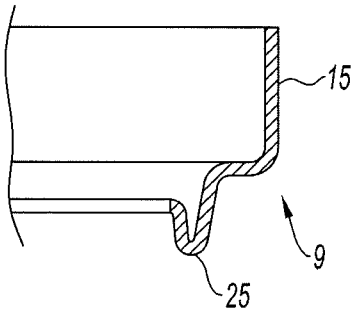
FIG. 8 is similar to FIG. 7 for a variant embodiment of the manifold.

FIG. 8 shows a manifold for an embodiment in which no slot 13 is provided, the seal then being held in position between the tubes 3 (not visible in this figure) and the border 15 of the manifold.

Figure 9:
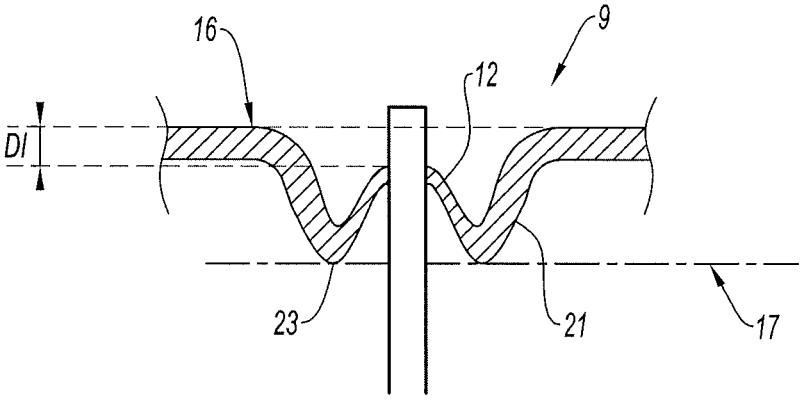
FIG. 9 represents schematically a portion of the detail IV, the manifold and a fluid circulation tube being in a first assembly configuration.
Figure 10:
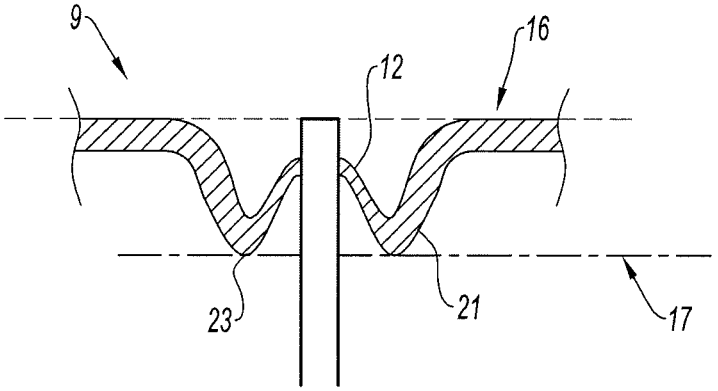
FIG. 10 is similar to FIG. 9, the tube and the manifold being in a second assembly configuration.

FIGS. 9 and 10 show another aspect of the invention according to which the free end of the collar 19 is situated as close as possible at a distance D1 of 2 millimeters from the internal envelope plane 16, on the side of this plane opposite to the collecting box. This makes it possible to have a tube 3 so that its end protrudes at most by 2 millimeters from the internal envelope plane of the manifold 9, on the side of this plane oriented toward the inside of the collecting box 5 (FIG. 9). It also becomes possible to place the end of the tubes on this internal envelope plane (FIG. 10).

Figure 11:
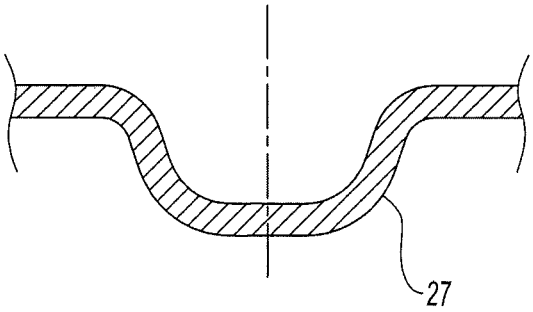
FIGS. 11 to 13 represent a portion of the detail IV in longitudinal section, in different steps of its formation.
Figure 12:
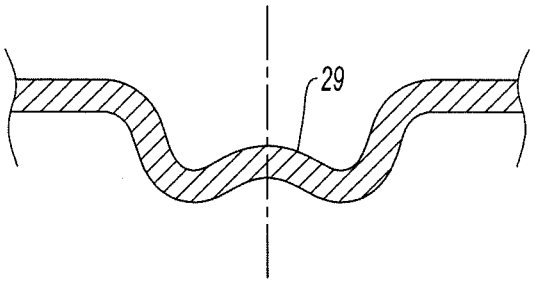
Figure 13:
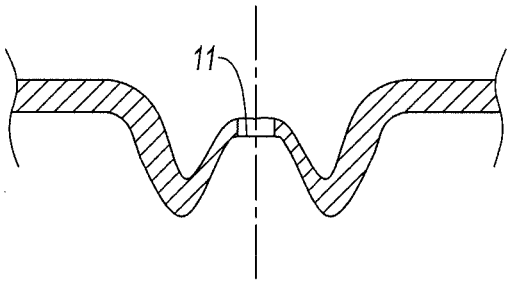

FIGS. 11 to 13 illustrate the production of the portion for receiving the ends of the tubes 3.

In a first step, illustrated in FIG. 11, a portion of a metal plate is formed into a boss portion 27. This involves at least one stamping operation carried out from a large face of the plate, which will form the internal surface of the manifold, in the direction of the opposite large face, which will form the external surface of the manifold. This deformation of the manifold is carried out practically keeping the thickness of the plate constant on the portions of this plate forming the boss 27.

In a second step, illustrated in FIG. 12, the top of the boss 27 is formed into a boss 29 rising in a direction opposite to the direction of elevation of the boss 27. This involves at least one stamping operation carried out from the external face to the internal face.

In a third step, illustrated in FIG. 13, the boss 29 is pierced, from the external face of the coverplate 9, in order to form an orifice 12 at the top of the boss 29. This piercing results in a thinning of the manifold and a lengthening of the boss 29 such that a collar 19 is formed.

The invention is not limited to the embodiments described above only as examples, but embraces all the variants that those skilled in the art can envisage. In particular, the shape of the cross section of the tubes 3 may be different from that described, for example round, "bean-shaped", rectangular or another shape. The number of layers of tubes can also vary. And all while remaining within the context of the invention, the retention zones may protrude slightly inwardly beyond the internal envelope plane.

The invention claimed is:

1. A heat exchanger comprising:

elongate tubes arranged in an arranging direction parallel to each other, adapted to the circulation of a coolant fluid; and at least one collecting box for the coolant fluid into which one end of each of said tubes leads, wherein the collecting box comprises:

a manifold that receives the one end of each of said tubes, wherein the manifold comprises:

inwardly protruding portions formed in a retention zone for the tube, each of the portions of the inwardly protruding portions protrude in an insertion direction of the tubes and is in contact with and retains one of the tubes, and connecting portions that connect a first protruding portion of the protruding portions to a second protruding portion of the protruding portions of the manifold, wherein each of the connecting portions protrude in a direction opposite to the insertion direction of the tubes, so that the protruding portion and the connecting portion protrude in opposite directions, wherein each of the protruding portions comprises an orifice that is longer in a direction perpendicular to the arranging direction and the insertion direction than in the arranging direction, wherein the protruding portions have a smaller thickness than the connection portions, and wherein the inwardly protruding portions have a shorter length along the insertion direction of the tubes than a length of the connecting portions along the insertion direction of the tubes.

2. The exchanger as claimed in claim 1, wherein the protruding portions and the connecting portions protrude in parallel to a longitudinal direction of the tube.

3. The exchanger as claimed in claim 1, wherein the retention zone is arranged to match a shape of an outside of each of the tubes in a vicinity of an end of the tube leading into the collecting box.

4. The exchanger as claimed in claim 3, further comprising:

bases that connect the connecting portions to other portions of the manifold, situated in an internal envelope plane of the manifold, wherein the protruding portion is set back from said internal envelope plane, so that said retention zone does not protrude inwardly beyond said internal envelope plane.

5. The exchanger as claimed in claim 4, wherein the end of the tube protrudes at most by 2 millimeters from said internal envelope plane of the manifold, on a side of the internal envelope plane oriented toward an inside of the collecting box.

6. The exchanger as claimed in claim 4, wherein the end of the tube is placed on the internal envelope plane of the manifold.

7. The exchanger as claimed in claim 4, wherein the end of the tube is situated at a distance less than 4 millimeters from the internal envelope plane of the manifold, on a side of the internal envelope plane oriented toward an outside of the collecting box.

8. The exchanger as claimed in claim 1, wherein the manifold is made of a plate material with a thickness of between 0.8 and 1.8 millimeter.

9. The exchanger as claimed in claim 1, further comprising a cluster of tubes adapted to the circulation of the coolant fluid, wherein the cluster has a spacing pitch of the tubes of between 5 and 15 millimeters.

10. The exchanger as claimed in claim 1, wherein the collecting box comprises a cover.

11. The exchanger as claimed in claim 1, wherein the collecting box comprises a cover brazed onto the manifold.

12. The exchanger as claimed in claim 1, wherein said tubes are obtained by folding a sheet of material.

13. The exchanger as claimed in claim 12, wherein said tubes are furnished with corrugations protruding inwardly.

14. A collecting plate for a heat exchanger as claimed in claim 1.

* * * * *